United States Patent [19]

Schuster

[11] Patent Number: 4,878,612

[45] Date of Patent: Nov. 7, 1989

[54] WRAP-AROUND CARTON WITH LOCKING FLAP CONNECTION

[75] Inventor: Richard L. Schuster, Monroe, La.

[73] Assignee: Manville Corporation, Denver, Colo.

[21] Appl. No.: 182,540

[22] Filed: Apr. 18, 1988

[51] Int. Cl.[4] ..... B65D 65/06

[52] U.S. Cl. ..... 229/40; 206/427

[58] Field of Search ..... 229/40; 206/427, 434, 206/140

[56] References Cited

U.S. PATENT DOCUMENTS

| | | | |
|---|---|---|---|
| 4,164,286 | 8/1979 | Sutherland | 229/40 |
| 4,437,606 | 3/1984 | Graser | 229/40 |
| 4,577,799 | 3/1986 | Oliff | 229/40 |
| 4,609,143 | 9/1986 | Collura et al. | 229/40 |
| 4,611,754 | 9/1986 | Sutherland | 229/40 |
| 4,679,726 | 7/1987 | Oliff | 229/40 |

FOREIGN PATENT DOCUMENTS

| | | | |
|---|---|---|---|
| 3935 | 9/1979 | European Pat. Off. | 229/40 |
| 2433711 | 1/1975 | Fed. Rep. of Germany | 229/40 |

*Primary Examiner*—Gary Elkins

*Attorney, Agent, or Firm*—John D. Lister

[57] ABSTRACT

A wrap-around carton with overlapping flaps overlying a substantially flat surface of the packaged article. A tab on the outer flap extends into a slot in the inner flap, with shoulders formed from a slot in the outer flap engaging the edge of the slot in the inner flap to mechanically connect the flaps together. In addition, a tab on the inner flap is inserted into the slot in the outer flap, whereby the inner flap tab urges the shoulders down so as to hold the locking mechanism in place and the edge of the slot in the outer flap holds the inner flap tab in place.

11 Claims, 3 Drawing Sheets

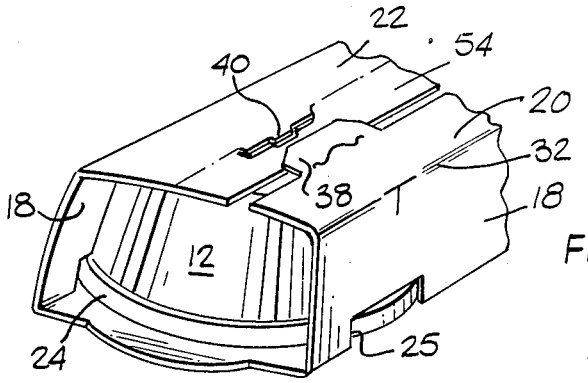
FIG. 3
FIG. 5
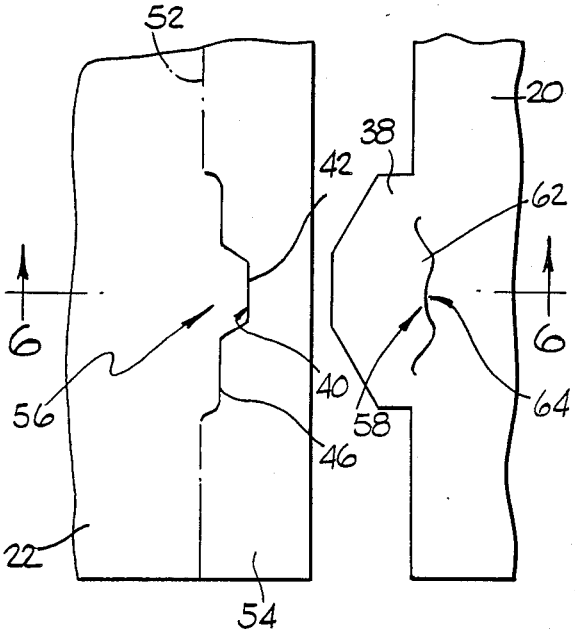
FIG. 8
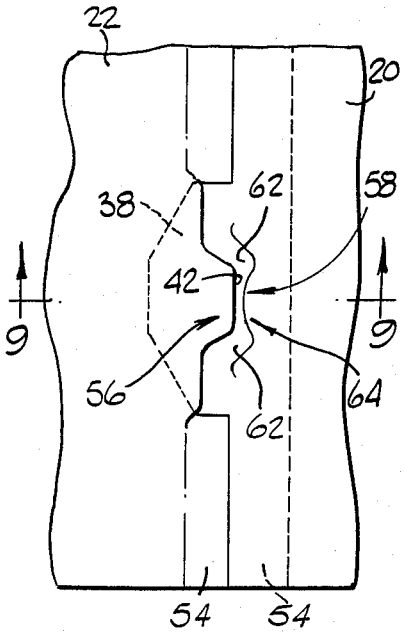
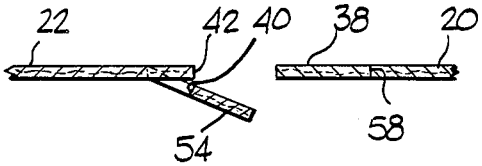
FIG. 6
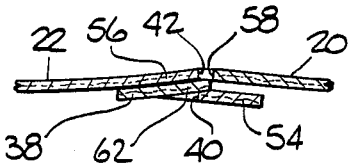
FIG. 9

FIG 10
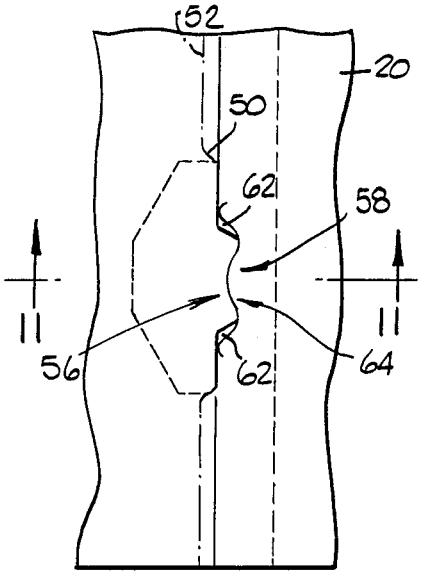
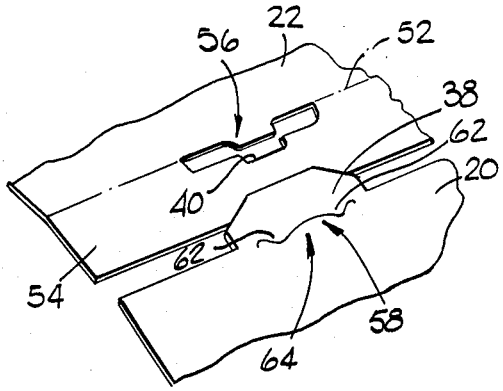
FIG. 4
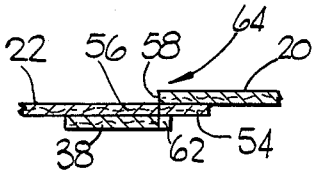
FIG. 11
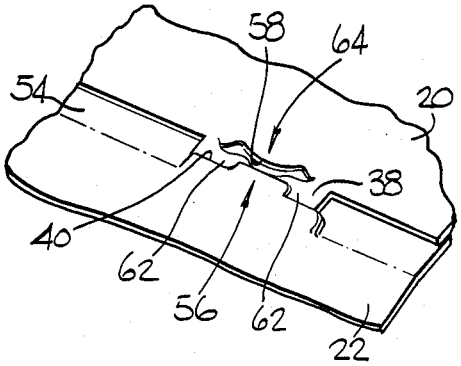
FIG. 7
FIG. 12
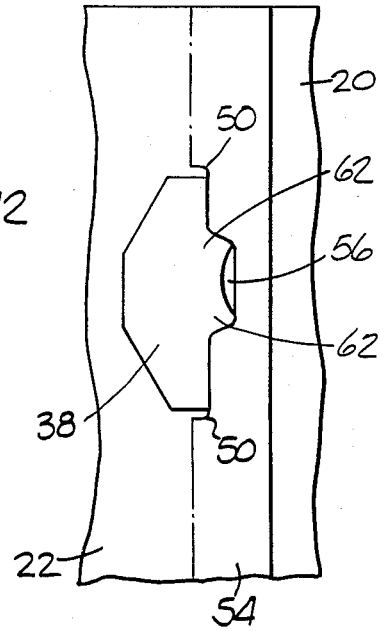

WRAP-AROUND CARTON WITH LOCKING FLAP CONNECTION

FIELD OF THE INVENTION

This invention relates to wrap-around cartons. More particularly, it relates to wrap-around cartons having mechanical locking means for connecting adjacent panel flaps.

BACKGROUND OF THE INVENTION

Wrap-around cartons are normally formed on a high speed packaging machine which wraps a carton blank around the article or articles to be packaged and secures the ends of the blank in place. The ends of the blank typically overlap to form one of the panels of the carton, often the bottom panel. The overlapping panel flaps are held together by mechanical locking arrangements consisting of interlocking elements integral with the flaps. Although there are many different types of locking arrangements, it is necessary, particularly when the connected flaps comprise the bottom panel of the carton and are thus subjected to the full weight of the articles when the carton is lifted, to utilize a locking mechanism which prevents the panel flaps from opening under the stresses of normal use.

In one type of lock an integral tab in one of the flaps mates with a slot in the other flap. The tab has an arrowhead configuration wherein the back edge of the arrowhead engages with a surface of the second flap to prevent withdrawal of the tab. Mechanical fingers and other elements of the packaging machine position the flaps and insert the tab through the slot, all at a very high speed. This operation works well in connection with cartons containing articles which are spaced from each other a distance sufficient to enable the locking tabs to be located at points corresponding to the spaces. With such an arrangement the tabs can be pushed up into the interior of the carton when forming the interlock without encountering interference from the articles. Beverage container carriers are examples of cartons of this type. Even though the beverage bottles are adjacent one another, the circular shape of the bottle bottoms results in blank areas in the bottom panel unoccupied by the bottles. The locking elements can be located in these areas.

Even without spaces between the articles, there may be room in the interior of the package to permit tabs aligned with the articles to be secured in place. For example, if the package design permits some vertical movement of the articles there may be enough room to vertically insert the tabs when the articles and the partially formed carton are upside down, which often is the case when forming a carton around bottles.

When packaging articles which do not provide for blank unoccupied space in the bottom panel or which are held tightly in place in the carton with no room to move, there is no space available, or at best only extremely limited space, for the vertical insertion of locking tabs. This situation does not therefore permit the use of the usual vertically assembled locking tab arrangements designed to prevent the mechanical interlock from being pulled apart. The close proximity of the mechanical lock to the flat bottom of the articles largely permits only slight vertical tab movement during package assembly. An example of the type of package presenting this problem is a carton containing one or more tubs of food, such as butter. The tubs are tightly held in the carton with virtually no space between the tub and the top and bottom panels of the carton. The tubs extend substantially the full width of the carton, leaving no space for assembly of the usual type of vertically movable locking tabs.

It would be desirable to provide a locking mechanism which provides for the interlocking of adjacent overlapping panel flaps but which does not require vertical movement by an element of the packaging machine to insert the locking tabs. It would also be desirable to provide added protection in such an arrangement against withdrawal of the locking tabs.

SUMMARY OF THE INVENTION

In a wrap-around paperboard carton holding an article having a substantially flat surface, the carton has a panel formed from overlapping outer and inner flaps which is in close face-to-face proximity to the flat surface of the article. The inner flap has a slot spaced from the outer edge thereof and the outer flap has a tab extending beyond the outer edge of the outer flap and through the slot in the inner flap. The inner flap has a slot forming an edge spaced from the outer edge of the inner flap, and locking means are provided on the outer flap to engage the spaced edge of the inner flap and secure the flaps together. Means are also provided for holding the locking means in locked condition to prevent withdrawal thereof from the inner flap.

The locking means that engages the spaced edge of the inner flap comprises a shoulder or tab formed in the outer flap by a slot therein. The means for holding the locking means in locked condition comprises a tab on the inner flap which engages the outer flap adjacent the slot therein to hold the shoulder means in position. In addition, an edge of the slot in the outer flap holds the tab means of the inner flap in position. Thus the locking shoulder is held in place by a tab which itself is held in place by a separate edge or tab structure to provide a double locking arrangement.

The lock is implemented merely by relative horizontal movement of the inner and outer flaps. Entry of the tab on the outer flap into the slot in the inner flap automatically causes the tab of the inner flap to enter the slot in the outer flap to produce the described locking arrangement. Because their is no need for vertically moving machine elements to provide vertical movement to the locking tabs, the locking mechanism of the invention is ideally suited for use with articles that abut or are in very close proximity to the panel containing the locking mechanism.

The features of the invention can readily be incorporated into carton blanks and can readily be accommodated by wrap-around packaging machines.

Other features and aspects of the invention, as well as other benefits of the invention, will be ascertained in the more detailed description of the invention which follows.

BRIEF DESCRIPTION OF THE DRAWINGS

FIG. 3 is a partial pictorial view showing the bottom side of the carton of FIG. 1 before the bottom panel flaps have been connected together;

FIG. 4 is an enlarged partial pictorial view showing the flaps of the bottom panel and the locking components thereof as they are initially moved toward each other;

FIG. 5 is an enlarged partial plan view of the outer surface of the pair of locking components shown in FIG. 4;

FIG. 6 is a transverse sectional view taken along line 6—6 of FIG. 5;

FIG. 7 is another enlarged partial pictorial view from a different perspective than that of FIG. 4, showing the flaps of the bottom panel in an intermediate stage of being connected together;

FIG. 8 is a view similar to that of FIG. 5, but showing the locking components in the intermediate stage of the locking operation of FIG. 7;

FIG. 9 is a transverse sectional view taken along line 9—9 of FIG. 8;

FIG. 10 is a view similar to that of FIG. 8, but showing the locking components in final locking condition;

FIG. 11 is a transverse sectional view taken along line 11—11 of FIG. 10; and

FIG. 12 is an enlarged plan view of the inside surface of the locked components of FIG. 10.

DESCRIPTION OF THE INVENTION

Figure 1:
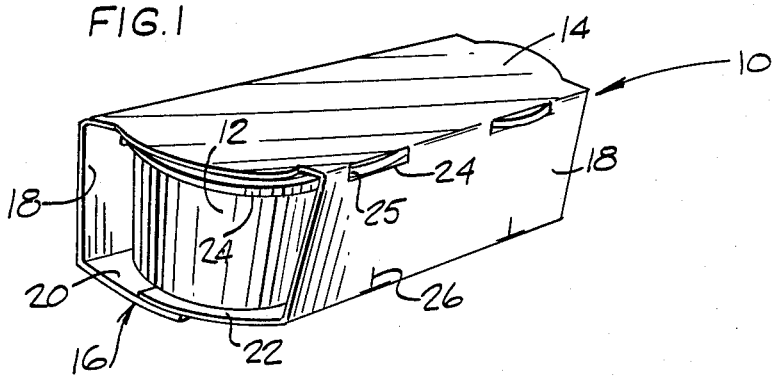
FIG. 1 is a pictorial view of a carton incorporating the locking means of the present invention.

Referring to FIG. 1, a carton 10 containing the two foods tubs 12 is comprised of a top panel 14 and bottom panel 16 foldably connected to side panels 18. The bottom panel 16 is comprised of an outer flap 20 which overlaps and is connected to an inner flap 22. The invention is not limited to cartons which contain articles such as those shown, but may be incorporated in any carton where there is little or no space in which to vertically insert locking tabs. The food tubs 12 illustrated in FIG. 1 are the flap-bottomed plastic tubs that hold butter or other spreads, the bottoms of which engage the bottom panel 16 of the carton. The lid 24 projects through openings 25 in the side of the carton 10 which allow the side panels 18 to closely conform to the side walls of the tubs, and the sides of the carton adjacent the bottom panel contain slits 26 which permit the carton to accept slight variations in the size or position of the tubs.

Figure 2:
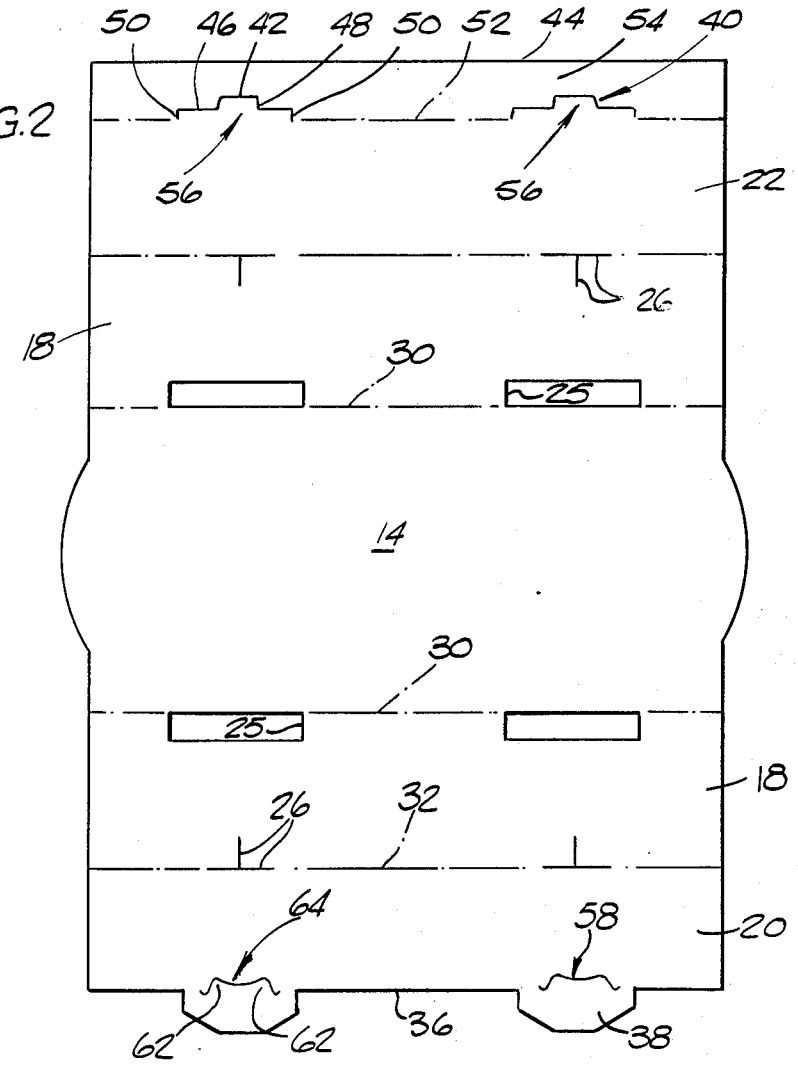
FIG. 2 is a plan view of a production blank for forming the carton of the present invention.

Referring to FIG. 2, a rectangular production blank 28 for forming the carton 10 is comprised of a top panel section 14 connected to side panel sections 18 along fold lines 30. One of the side panel sections 18 is connected along fold line 32 to outer bottom panel flap 20, while the other side panel section 18 is connected along fold line 34 to inner bottom panel flap 22. Projecting from the outer edge 36 of the outer flap 20 are two spaced tabs 38. The inner flap 22 has two slots 40 aligned with the tabs 38. Each slot 40 is comprised of a cut 42, which is generally parallel to and spaced from the outer edge 44 of the flap 22, and cuts 46, which are also generally parallel to but spaced farther from the edge 44 than the cut 42. Inwardly extending cuts 48 connect the cuts 42 and 46, and inwardly extending cuts 50 connect the cuts 46 to score line 52. The score line 52 is parallel to the outer edge 44, the area between the score line 52 and the outer edge 44 comprising a margin area 54. The portions of the inner flap 22 which are bounded by the cuts 42, 46, 48 and 50 thus form tabs 56.

Located in the body of the flap 20 slightly inwardly of the tabs 38 are slots 58 having arcuate end portions 60 for preventing tearing. The main portion of each slot 58 is undulated to form two projections or shoulders 62. The portions of the outer flap 20 which are bounded by the slots 58 thus form tabs 64.

FIG. 3 shows the blank of FIG. 2 after it has been wrapped or folded around a tub 12 to an intermediate point in the assembly of the carton. The tab 38 of outer flap 20 is aligned with the slot 40 of inner flap 22 but the bottom flaps 20 and 22 have not yet been connected together. Although the carton is shown in inverted position in order to better illustrate the locking elements, it should be understood that the carbon may be held in any position best suited for the packaging machine employed. It should also be understood that although the carton has been shown as holding two tubs, the invention is not limited to cartons containing any particular number of tubs or other articles, nor is it limited to the use of any particular number of locking tabs and slots. The number and arrangement of the locking tabs and slots may be varied in accordance with the size and weight of the articles contained in the carton.

The relative locations of the locking components of the partially formed carton of FIG. 3 are shown in more detail in FIGS. 4, 5 and 6, wherein the flaps 20 and 22, including the tab 38 and slot 40, are spaced from each other in aligned position. The slot 40 is shown in slightly open condition as it would be when the margin 54 is bent about score line 52 to a position slightly out of the plane of the main body portion of the flap 22. The flaps 20 and 22 would be in this position as a result of being appropriately manipulated by elements of the packaging machine, not shown but which are well known in the art. This slight nonplanar arrangement is easily accommodated by the space immediately adjacent the bottom of the food tub since the flaps in their initial unattached condition are spaced from the tub a sufficient distance to allow the slight bending of the margin to take place. As shown, the slot 40 is in position to receive the tab 38 when the flaps 20 and 22 are moved toward each other in a generally horizontal manner.

FIGS. 7, 8 and 9 show the flaps in an intermediate stage in the process of being connected together. As a result of being moved generally horizontally toward each other, the tab 38 of the flap 20 has been partially inserted into the slot 40 of the flap 22. As the tab 38 is sliding into the slot 40, the bottom surface of the tab 56 of the flap 22 slides over the upper surface of the tab 38. The result of these movements is to apply sufficient downward pressure on the tab 38 so as to cause it to bend downwardly a slight distance sufficient to move it out of the plane of the flap 20. This is able to occur because the paperboard is stiff enough to allow the tabs to exert pressure on other components of the lock while still maintaining their physical integrity.

At this stage of the locking process the shoulders 62 of the tab 38 will have been pushed down from their normal location adjacent the cut line forming the slot 58 by the camming action of the tab 56 of flap 22. At the same time, the movement of the tab 38 into the slot 40 in the flap 22 will have further forced down the margin 54 so that the edge of the slot 40 is situated below the tab 38.

Continued relative movement of the flaps 20 and 22 causes the locking elements to reach the fully locked positions shown in FIGS. 10 and 11, wherein the tab 38 has moved across the upper surface of the margin 54 until the shoulders 62 reach the cuts 46 and snap down beneath the flap 22 and its margin 54. The normal memory of the resilient paperboard and the weight of the articles in the carton cause the shoulders to snap into position behind the cuts 46 of the slot 40. This arrangement is illustrated more clearly in FIG. 12, which depicts the inner surface of the connected flaps and shows the tab 38 in locking position inside the bottom panel of the carton.

As will be understood from the descriptive material, and particularly from FIGS. 5, 7, 10 and 11, in final locked position the various tabs hold the locking components in place and prevent them from being disconnected. Thus tab 56, formed from the slot 40, maintains pressure on the tab 38 in the direction of the interior of the carton to hold the tab 38 and its connected shoulders 62 in locking engagement with the edges 46 of the slot 40 located in the margin 54 and with the interior surface of the margin 54 adjacent the slot. In addition, the lowermost edge in the flap 20 formed by the portion of the slot 58 located between the shoulders 62, or in other words the tab 64, functions to maintain locking pressure on the exterior surface of the tab 56. The invention thus results in a double locking arrangement to prevent withdrawal of the locking tab 36.

It can now be understood that locking engagement of the tabs and slots incorporated in the panel flaps of the present invention does not require vertically moving insertion elements of the packaging machine to move into the interior of the carton. It merely requires relative movement of the flaps toward each other in a plane generally parallel to the adjacent surface of the article inside the carton. The tabs themselves, as they move into their associated slots, bring about the vertical component of movement required to engage the locking shoulders of the first tab 38 in place beneath the locking edge of the inner flap, and the unique double locking design insures against withdrawal of the locking structure.

It should be understood, after reading the foregoing description of the preferred embodiment of the invention, that changes to certain specific features of the preferred embodiment may be made in the practice of the invention without affecting the overall performance and concept of the locking mechanism and without departing from the spirit and scope of the invention.

What is claimed is:

1. In a wrap-around paperboard carton containing an article having a substantially flat surface;

a panel in close face-to-face proximity with the substantially flat surface of the article;

the panel comprising overlapping inner and outer flaps, each flap having an outer edge, an exterior face and an interior face;

the inner flap having a slot forming an edge spaced from the outer edge thereof;

the outer flap having a tab having an outer extremity, the tab extending beyond the outer edge of the outer flap and through the slot in the inner flap;

locking means on the outer flap engaging the spaced edge of the inner flap to secure the flaps together; and means for holding the locking means in locking condition to prevent withdrawal thereof from the inner flap;

the locking means comprising shoulder means engaging the spaced slot edge of the inner flap;

the outer flap containing a slot spaced from the outer extremity of the tab, the shoulder means being defined by an edge of the slot;

the means for holding the locking means in locked condition comprising tab means on the inner flap engaging the outer flap adjacent the slot therein to hold the shoulder means in position; and the tab means on the inner flap extending through the slot in the outer flap and being held in position by an edge of said slot, whereby the tab means is maintained in position to hold the shoulder means in place.

2. In a paperboard carton according to claim 1, wherein the edge of the slot holding the tab means of the inner flap in position comprises a second tab means in the outer flap.

3. In a paperboard carton according to claim 2, wherein the shoulder means comprises two shoulders connected by an edge corresponding to the perimeter of the second tab means in the outer flap.

4. In a wrap-around paperboard carton containing an article having a substantially flat surface:

a panel in close face-to-face proximity with the substantially flat surface of the article;

the panel comprising overlapping inner and outer flaps, each flap having an outer edge, an exterior face and an interior face;

the inner flap having a slot forming an edge spaced from the outer edge thereof;

the outer flap having a tab having an outer extremity, the tab extending beyond the outer edge of the outer flap and through the slot in the inner flap;

locking means on the outer flap engaging the spaced edge of the inner flap to secure the flaps together; and means for holding the locking means in locking condition to prevent withdrawal thereof from the inner flap;

the locking means comprising shoulder means engaging the spaced slot edge of the inner flap;

the outer flap containing a slot spaced from the outer extremity of the tab, the shoulder means being defined by an edge of the slot;

the means for holding the locking means in locked condition comprising tab means on the inner flap engaging the outer flap adjacent the slot therein to hold the shoulder means in position; and the slot in the inner flap being comprised of an intermediate portion and outer portions, and the tab means on the inner flap being defined by the intermediate portion of the slot, the tab means being spaced from the outer edge of the inner flap a lesser distance than the outer portions of said slot.

5. A blank for forming a wrap-around paperboard carton for holding an article having a substantially flat surface, comprising:

a paperboard blank having opposite end portions adapted to be connected together in overlapping relationship to form a panel in close face-to-face proximity with the substantially flat surface of the article;

one of the end portions comprising an outer flap and the other of the end portions comprising an inner flap, each flap having an outer edge, side edges, an exterior face and an interior face;

the inner flap having a slot spaced from the outer edge thereof;

fold lines connecting the slot in the inner flap to the side edges of the inner flap;

the outer flap having a tab extending beyond the outer edge of the outer flap and adapted to extend through the slot in the inner flap;

the inner flap having an edge spaced from the outer edge of the inner flap;

locking means on the outer flap adapted to engage the spaced edge of the inner flap to secure the flaps together; and means on the flaps for holding the locking means in locking condition.

6. A paperboard blank according to claim 5, wherein the locking means comprises shoulder means on the outer flap adapted to also engage the interior face of the inner flap between the slot therein and the outer edge of the inner flap.

7. A paperboard blank according to claim 5, wherein the outer flap contains a slot spaced from the extremity of the tab, the shoulder means being defined by an edge of the slot, and wherein the means for holding the locking means in locked condition comprises tab means on the inner flap adapted to engage the outer flap adjacent the slot therein to hold the shoulder means in position.

8. A paperboard blank according to claim 7, wherein the tab means on the inner flap is adapted to extend through the slot in the outer flap and is held in position by an edge of said slot in the outer flap, whereby the tab means is maintained in position to hold the shoulder means in place.

9. A paperboard blank according to claim 8, wherein the edge of the slot holding the tab means of the inner flap in position comprises a second tab means in the outer flap.

10. A paperboard blank according to claim 5, wherein the slot in the inner flap comprises a slit formed by a cut in the inner flap.

11. A paperboard blank according to claim 7, wherein the slot in the outer flap comprises a slit formed by a cut in the outer flap.

* * * * *